US005697027A

United States Patent [19]

Takagi et al.

[11] Patent Number: 5,697,027

[45] Date of Patent: Dec. 9, 1997

[54] DEVELOPING ROLLER EMPLOYING AN ELASTIC LAYER BETWEEN CONDUCTIVE SHAFT AND OUTER CONDUCTIVE LAYER AND DEVELOPING APPARATUS

[75] Inventors: Koji Takagi, Kawasaki; Yoshio Takizawa, Fussa; Takahiro Kawagoe, Tokorozawa, all of Japan

[73] Assignee: Bridgestone Corporation, Tokyo, Japan

[21] Appl. No.: 714,324

[22] Filed: Sep. 18, 1996

[30] Foreign Application Priority Data

Sep. 20, 1995 [JP] Japan ..... 7-242129
Dec. 11, 1995 [JP] Japan ..... 7-321908

[51] Int. Cl.[6] ..... G03G 15/08

[52] U.S. Cl. ..... 399/279

[58] Field of Search ..... 399/265, 279, 399/287, 252, 280, 281; 430/120

[56] References Cited

U.S. PATENT DOCUMENTS 3,863,603 2/1975 Buckley et al. ..... 399/279 X
5,248,560 9/1993 Baker et al. ..... 399/279

*Primary Examiner*—S. Lee
*Attorney, Agent, or Firm*—Sughrue, Mion, Zinn, Macpeak & Seas, PLLC

[57] ABSTRACT

A developing roller (1) having a highly conductive shaft (2), an elastic layer (3) having conductivity around the shaft, and a conductive layer (4) on the elastic layer containing carbon black having an oil absorption of 30–80 ml/100 g and a specific surface area of 30–150 $m^2/g$. The developing roller carries a developer on its surface and comes in contact with or close to a photoconductor drum having an electrostatic latent image borne on its surface whereby the developer is supplied to the photoconductor drum to visualize the latent image. The developing roller has a low hardness, ensures intimate contact with the photoconductor drum, and is improved in electric conduction stability and anti-staining so that acceptable images can be consistently produced over a long term.

10 Claims, 1 Drawing Sheet

DEVELOPING ROLLER EMPLOYING AN ELASTIC LAYER BETWEEN CONDUCTIVE SHAFT AND OUTER CONDUCTIVE LAYER AND DEVELOPING APPARATUS

BACKGROUND OF THE INVENTION

1. Field of the Invention

This invention relates to a developing roller and apparatus for use in electrophotographic and electrostatic recording machines such as copiers and printers for developing an electrostatic latent image with a developer for visualization. More particularly, it relates to a developing roller and apparatus which is improved in electric conduction stability and anti-staining so that acceptable images can be produced in a stable manner over a long term.

2. Prior Art

In conjunction with prior art electrophotographic and electrostatic recording machines such as copiers and printers, one typical developing method is an impression developing method as disclosed in U.S. Pat. Nos. 3,152,012 and 3,731,146. This developing method visualizes electrostatic latent images by supplying a non-magnetic one-component developer to a photoconductor drum bearing a latent image, thereby adhering the developer to the latent image. Since the impression developing method eliminates a need for magnetic material, the apparatus can be simple and compact and color toner can be used.

More particularly, the impression developing method is accomplished by bringing a developing roller carrying a toner or non-magnetic one-component developer in contact with a latent image holder or photoconductor drum bearing an electrostatic latent image, thereby adhering the toner to the latent image. The developing roller must be formed of an elastic material having electrical conductivity.

Referring to FIG. 2, the impression developing method is briefly described. A developing roller 1 having a conductive elastomer layer is placed between a toner feed roller 5 for feeding a toner 7 and a photoconductor drum 6 having an electrostatic latent image borne thereon. In one arrangement, the developing roller 1 is in contact with the photoconductor drum 6 and slightly spaced apart from the toner feed roller 5. Upon rotation of the developing roller 1, photoconductor drum 6, and toner feed roller 5 in the directions shown by arrows, the toner 7 is fed from the feed roller 5 onto the surface of the developing roller 1 and regulated into a uniform thin layer by a doctor blade 8. The thin layer of toner is then delivered from the developing roller 1 to the photoconductor drum 6 to adhere to the latent image whereby the latent image is developed into a visible toner image. The toner image is finally transferred from the photoconductor drum 6 to a record medium, typically paper in a transfer section 9. Also included is a cleaning section 10 having a cleaning blade 11 for scraping off the toner left on the photoconductor drum 6 after the transfer step. In another arrangement, the developing roller 1 is slightly spaced apart from the photoconductor drum 6 so that only the thin layer of toner on the developing roller 1 may come in contact with the photoconductor drum 6.

During rotation, the developing roller 1 must maintain close contact with the photoconductor drum 6. Then the conventional developing roller 1 is of a structure having a conductive elastic layer 3 around a shaft 2 as shown in FIG. 1. The shaft 2 is of a highly conductive material, typically metal. The conductive elastic layer 3 is formed of a conductive elastomer in the form of an elastic rubber such as urethane rubber, silicone rubber, acrylonitrile-butadiene rubber (NBR), and ethylene-propylene-diene terpolymer (EPDM) or a sponge such as urethane foam, with a suitable conductive agent being blended therein. It was also proposed to form a conductive layer 4 of conductive powder-laden resin on the elastic layer 3. Even in the other arrangement wherein the developing roller 1 is slightly spaced apart from the photoconductor drum 6 so that only the developer layer on the developing roller 1 may come in contact with the photoconductor drum 6, a provision must be made such that the developer may always contact the photoconductor drum 6 under a constant pressure. This requires to form an elastic layer of the same structure as in the first-mentioned arrangement.

However, the prior art developing rollers had the following problems resulting from the properties of elastic layers used therein.

(1) Where the developing roller is formed of an elastic rubber such as urethane rubber, silicone rubber, NBR and EPDM having a low hardness enough to achieve tight contact, the photoconductor drum can be contaminated therewith. Since, for the low hardness rubber is difficult to polish the surface, the developing roller has no satisfactory surface.

(2) Where a surface layer is provided in order to overcome the above problems of contamination and poor surface quality, the surface layer must be thick. If the thick surface layer is free of conductive powder, the developing roller as a whole has a significantly increased resistance and does not perform well. If the surface layer contains a large amount of conductive powder, it loses self reinforcement due to its increased thickness so that it does not withstand long-term use.

(3) Where a spongy body such as urethane foam is used to form the elastic layer, toner can penetrate into pores in the elastic layer. As the penetrating toner accumulates on long-term use, the roller becomes harder and electrical charging of toner becomes inefficient, resulting in a drop of image quality.

(4) Where the developing roller has a single elastic layer, it creates a greater burden between the developing blade and the photoconductor because of a very large friction coefficient on its surface. This leads to uneven toner transfer and driving jitter, both resulting in defective images.

(5) Where the developing roller has a single elastic layer, charging of toner on the roller does not show a quick rise. This often invites fogging due to poor charging of toner, poor cleaning due to selective development, and a loss of print density. There occurs a substantial drop of print quality after long-term continuous printing.

Therefore, an object of the present invention is to provide a developing roller which has a relatively low hardness and is improved in tight contact, electric conduction stability and anti-staining so that acceptable images can be consistently produced over a long term. Another object of the present invention is to provide a developing apparatus using such a developing roller.

SUMMARY OF THE INVENTION

We have found that when a conductive layer containing carbon black having an oil absorption of up to 80 ml/100 g and a specific surface area of up to 150 $m^2/g$ is formed on the outer surface of the elastic layer, this surface conductive layer offers the advantages of increased thickness, improved surface quality and reduced friction while preventing contamination to the latent image holder or photoconductor drum.

In one aspect, the present invention is directed to a developing roller which is adapted to carry a developer on its outer surface to form a thin layer of the developer and come in contact with or close to a latent image holder having an electrostatic latent image borne on its surface whereby the developer is supplied to the latent image holder to visualize the latent image. In another aspect, the present invention provides an apparatus for developing an electrostatic latent image comprising a latent image holder for bearing an electrostatic latent image on its surface and a developing roller for carrying a developer on its outer surface wherein the developing roller is brought in contact with or close to the surface of the latent image holder whereby the developer is adhered to the latent image on the surface of the latent image holder to visualize the latent image. In either aspect, the developing roller according to the present invention is characterized by comprising a highly conductive shaft, an elastic layer formed around the shaft and having conductivity, and a conductive layer on the outer surface of the elastic layer containing carbon black having an oil absorption of up to 80 ml/100 g and a specific surface area of up to 150 $m^2/g$.

We have further found that better results are obtained when the conductive layer is formed of a resin composition comprising a soluble nylon copolymer or phenolic resin. Also, better results are obtained when the developer used is a positive chargeable one.

More particularly, soluble nylon copolymers are fully flexible. When the conductive layer is formed of a nylon copolymer with good film forming ability, the layer can be formed thick enough to withstand long-term use. Phenolic resins have a high ionization potential and electron acceptive nature. A conductive layer of phenolic resin exhibits excellent charging properties especially when the developer is positive chargeable. Both the soluble nylon copolymer and phenolic resin have a high dielectric constant and are effective for electrically charging the developer upon contact with the developer. By forming a conductive layer from a soluble nylon copolymer or phenolic resin, there is obtained a developing roller of high charging performance.

The following benefits are obtained where the developer used is a positive chargeable one. With respect to the developer which has been charged positive by triboelectric charging, an electric charge of opposite polarity, that is, negative charge is induced on the roller surface. After the developer is transferred to the latent image holder or photoconductor drum, a negative charge remains on the roller surface. If the negative charge is left on the roller surface without scavenging, the charging efficiency drops in a next stage of charging a new developer, failing to provide a satisfactory rise of charging. Therefore, the negative charge induced on the developing roller surface must be effectively scavenged. Common polymeric resins are deleterious to the mobility of negative charge, that is, electrons because hole transportation takes place preferentially. The conductive layer containing specific carbon black according to the invention provides the roller surface with excellent electron conducting ability, allows the residual negative charge to be effectively removed, and thus improves the rise of charging of the developer, ensuring repetition of satisfactory development.

Therefore, one preferred embodiment of the invention provides a developing roller of the above-defined construction wherein the conductive layer is formed of a resin composition comprising a soluble nylon copolymer or phenolic resin. Another preferred embodiment of the invention provides a developing roller of the above-defined construction which is used to develop the electrostatic latent image with a positively charged one-component developer. Also contemplated is a developing apparatus comprising a developing roller according to these preferred embodiments.

BRIEF DESCRIPTION OF THE DRAWINGS

These and further features of the present invention will be apparent with reference to the following description and drawings, wherein.

DESCRIPTION OF THE PREFERRED EMBODIMENTS

Figure 1:
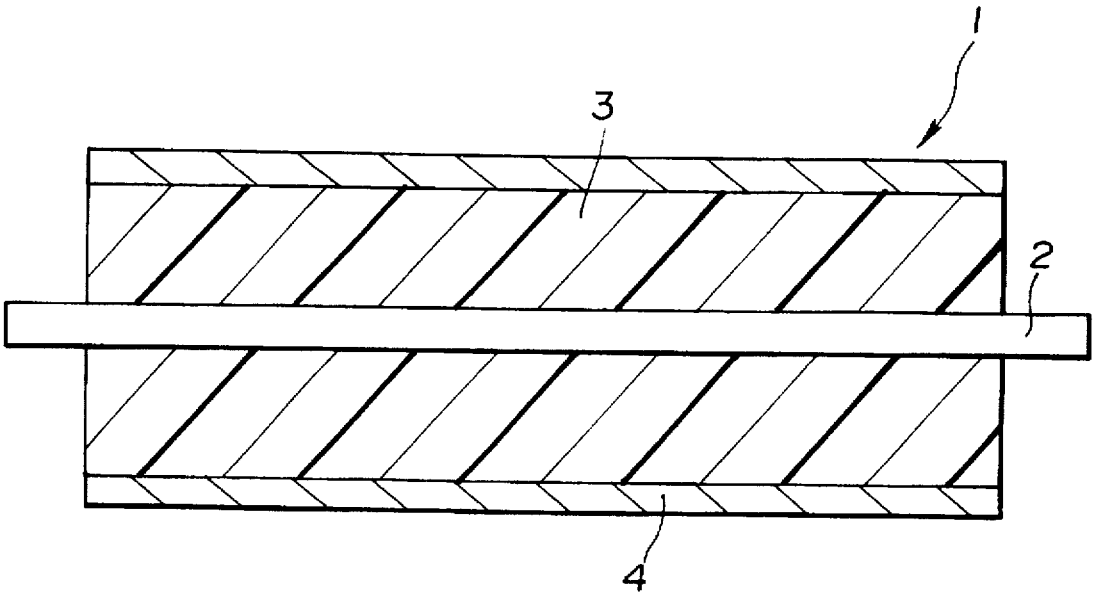
FIG. 1 is a schematic cross-sectional view of a developing roller according to the invention.

Referring to FIG. 1, there is illustrated a developing roller according to the invention. The developing roller 1 includes a highly conductive shaft 2, an elastic layer 3 formed around the shaft 2 and having conductivity, and a conductive layer 4 on the outer surface of the elastic layer 3. The conductive layer 4 contains carbon black having an oil absorption of up to 80 ml/100 g and a specific surface area of up to 150 $m^2/g$.

Any desired shaft may be used insofar as it is a good conductor. The shaft is typically selected from metallic and resinous shafts, for example, solid cores and hollow cylinders.

The elastic layer 3 around the shaft 2 is generally formed of a composition comprising an elastomer (typically polyurethane and EPDM) or foam and a conductive agent. Examples of the conductive agent include conductive powders such as carbon black, metals and metal oxides and ionic conductive substances such as sodium perchlorate although the conductive agent will be described later in more detail. The conductive agent is blended such that the composition (elastic layer) may have a resistance in the medium range of $10^3$ to $10^{10}$ Ωcm, especially $10^4$ to $10^8$ Ωcm. With a resistance of less than $10^3$ Ωcm, electric charges can leak to the photoconductor drum and the developing roller itself can be broken by the applied voltage. With a resistance of more than $10^{10}$ Ωcm, background fogging would often occur in the resultant image.

The base of the elastic layer composition is generally selected from polyurethane, natural rubber, butyl rubber, nitrile rubber, polyisoprene rubber, polybutadiene rubber, silicone rubber, styrene-butadiene rubber, ethylene-propylene rubber, ethylene-propylene-diene terpolymer (EPDM), chloroprene rubber, acryl rubber, and mixtures thereof. Polyurethane and EPDM are preferred.

Polyurethane is first described. There may be used any of polyurethane elastomers and foams which are conventionally prepared. For example, they may be prepared by blending carbon black in polyurethane prepolymer and subjecting the prepolymer to crosslinking reaction. Another known method is by blending a conductive material in a polyhydroxyl compound and reacting it with a polyisocyanate by a one-shot technique. The polyurethane is generally prepared from a polyhydroxyl compound and a polyisocyanate compound. As the polyhydroxyl compound, use may be made of polyols commonly used in the preparation of flexible polyurethane foams and urethane elastomers, such as polyether polyols and polyester polyols terminated with a polyhydroxyl group, and polyester polyether polyols obtained by copolymerizing the former two; and other conventional polyols, for example, polyolefin polyols such as polybutadiene polyols and polyisoprene polyols, and polymer polyols obtained by polymerizing ethylenically unsaturated monomers in polyols. Examples of the polyisocyanate compound include polyisocyanates commonly used in the preparation of flexible polyurethane foams and urethane elastomers, such as tolylene diisocyanate (TDI), crude TDI, diphenylmethane-4,4'-diisocyanate (MDI), crude MDI, aliphatic polyisocyanates having 2 to 18 carbon atoms, alicyclic polyisocyanates having 4 to 15 carbon atoms, and mixtures and modified products of these polyisocyanates, e.g., prepolymers partially reacted with polyols. Usually the polyisocyanate and polyol are mixed in a ratio between about 1/1 and about 1.3/1. A mix ratio of less than 1 is acceptable particularly when it is desired to reduce the hardness of the elastomer layer.

EPDM is a terpolymer of ethylene, propylene, and a third component. The third component is not critical although it is preferably selected from dicyclopentadiene, ethylidene norbornene, and 1,4-hexadiene. The proportion of ethylene, propylene, and the third component is not critical although it is preferred that the content of ethylene is 5 to 95% by weight, the content of propylene is 5 to 95% by weight, and the content of third component corresponds to an iodine value of 0 to 50. A mixture of two or more EPDM having different iodine values is also acceptable. Also EPDM may be blended with silicone rubber and/or silicone-modified EPDM. Better results are obtained when 100 parts by weight of EPDM is blended with 5 to 80 parts by weight of silicone rubber and/or silicone-modified EPDM. It is noted that the silicone-modified EPDM is a hybrid rubber wherein the bonding force between EPDM and silicone polymers is enhanced by a silanol compound or siloxane.

Crosslinking agents and vulcanizing agents may be added to the elastic layer composition in order to crosslink the base resin into a rubbery material of which the elastic layer is made. In either of organic peroxide crosslinking and sulfur crosslinking systems, crosslinking aids, vulcanization accelerators, vulcanization co-accelerators, and vulcanization retarders may be used. Additionally, there may be blended other additives commonly used in rubber, for example, peptizers, blowing agents, plasticizers, softeners, tackifiers, anti-tack agents, separating agents, mold release agents, extenders, and coloring agents.

To the elastic layer composition based on polyurethane or EPDM, there may be added various charge control agents such as Nigrosine, triaminophenylmethane, and cationic dyes for the purpose of controlling the charge quantity of toner on the surface of the developing roller as well as microparticulate fillers such as silicone resin, silicone rubber, and nylon. Better results are obtained when 100 parts by weight of polyurethane or EPDM is blended with 1 to 5 parts by weight of the charge control agent and 1 to 10 parts by weight of the microparticulate filler.

As previously mentioned, conductive agents including conductive powders and ionic conductive substances are blended in the elastic layer composition for imparting appropriate conductivity thereto. Examples of the conductive powder include conductive carbon such as Ketjen Black EC and acetylene black; carbon for rubber such as SAF, ISAF, HAF, FEF, GPF, SRF, FT, and MT; oxidized carbon for color ink; pyrolytic carbon; natural graphite, synthetic graphite; metals and metal oxides such as antimony-doped tin oxide, titanium oxide, zinc oxide, nickel, copper, silver and germanium; and conductive polymers such as polyaniline, polypyrrole, and polyacetylene. Among others, carbon black is preferred since it is inexpensive and easy to control conductivity with small amounts. Preferably about 0.5 to 50 parts, more preferably about 1 to 30 parts by weight of the conductive powder is blended with 100 parts by weight of the polyurethane or EPDM.

Examples of the ionic conductive substance include inorganic ionic conductive substances such as sodium perchlorate, lithium perchlorate, calcium perchlorate, and lithium chloride and organic ionic conductive substances such as modified aliphatic dimethylammonium ethosulfates, stearylammonium acetate, laurylammonium acetate, octadecyltrimethylammonium perchlorate, and tetrabutylammonium borofluoride. Preferably about 0.01 to 30 parts, more preferably about 0.01 to 5 parts by weight of the ionic conductive substance is blended with 100 parts by weight of the polyurethane or EPDM.

The elastic layer 3 is preferably given a hardness of up to 60°, especially 25° to 55° on JIS A scale. With a hardness of more than 60°, the contact area with the photoconductor drum would be reduced, failing to carry out satisfactory development. Too low hardness would invite an excessive compression set, which would cause a density variation in the toner image when the developing roller is deformed or radially misaligned for some reason or other. Then when the elastic layer is to be adjusted to a low hardness, it is preferred to minimize the compression set, typically to 20% or less.

In the developing roller of the invention, the conductive layer 4 is formed on the outer surface of the elastic layer 3 using a composition comprising a resin component and carbon black having an oil absorption of up to 80 ml/100 g and a specific surface area of up to 150 $m^2/g$. The use of specific carbon black enables to increase the thickness of the conductive layer 4, prevents contamination to the latent image holder or photoconductor drum, improves surface quality, and reduces surface friction.

If the oil absorption of carbon black exceeds 80 ml/100 g, a large amount of the resin component of the conductive layer can be taken into the interstices of carbon black, which is disadvantageous for the reinforcement of a resin coating. More specifically, when a resin coating is prepared by dissolving the resin component in a solvent, dispersing carbon black in the solution, casting the solution onto the elastic layer and drying, the resulting coating is poor in self-reinforcement and is likely to crack. This is more outstanding when the coating is thick. Since such carbon black, even when blended in a small amount, causes an abrupt drop of resin conductivity, it is difficult to provide a properly controlled conductivity. A similar phenomenon occurs when carbon black having a specific surface area of more than 150 $m^2/g$ is used.

The carbon black used herein should have an oil absorption of up to 80 ml/100 g and a specific surface area of up to 150 $m^2/g$. Preferably carbon black has an oil absorption of 30 to 80 ml/100 g and a specific surface area of 30 to 150 $m^2/g$. Such carbon black is commercially available under the trade name of Printex 35 and Printex 25 from Degussa Inc. Chemicals Div. and CF9 #52 and #45 from Mitsubishi Chemicals K.K. Preferably 5 to 60 parts, especially 10 to 40 parts by weight of carbon black is blended with 100 parts by weight of the resin component.

The resin component of the conductive layer-forming composition is not critical although soluble nylon copolymers and phenolic resins are preferred from the standpoints of self film reinforcement, carbon dispersion stability, and toner charging ability. The soluble nylon copolymers are nylon polymers which are made soluble in common organic solvents by copolymerizing nylon with another polyamide unit or chemically modifying an amide group of nylon. The phenolic resins may be of either resol type or novolak type and include simple phenolic resins obtained by reacting a phenol with an aldehyde, resorcinol resins using resorcinol instead of phenol, mixtures of a phenolic resin and a resorcinol resin, and various modified phenolic resins such as melamine, xylene and epoxy-modified phenolic resins. Preferred are simple phenolic resins, resorcinol resins, and mixtures thereof. Phenolic resins of the resol type are advantageous in that a cured coating can be formed on the urethane elastomer layer simply by heating without a need for crosslinking agents. It is also acceptable to blend the soluble nylon copolymer or phenolic resin with a silicone resin, melamine resin, fluorocarbon resin, alkid resin, modified resin thereof or a mixture thereof. Since the silicone resin, melamine resin, fluorocarbon resin, alkyd resin, and modified resin thereof have a series of tribo-electrification levels ranging from positive to negative charging, a suitable one is chosen from them in accordance with a particular development system so that a toner charge quantity adequate for that development system may be obtained.

Means for applying the conductive layer 4 onto the surface of the elastic layer 3 is most often by coating the elastic layer with a coating composition of carbon black dispersed in a resin and a solvent (sometimes referred to as conductive paint). The resin concentration of the coating composition is not critical although a resin concentration of at least 10% is desirable when it is desired to form a conductive layer of at least 50 μm thick. The solvent is not critical insofar as the resin is soluble therein. Preferred solvents include lower alcohols such as methanol, ethanol and isopropanol, ketches such as methyl ethyl ketone (MEK) and cyclohexanone, and aromatic solvents such as toluene and xylene. A mixture of such solvents is preferred in order to improve film formability in a drying step after coating. A dispersant may be added to the resin composition in order to improve the dispersion stability of carbon black.

After the resin composition is prepared, it may be applied to the elastic layer as by spraying, roll coating and dipping. In the case of dipping, for example, a roller having an elastic layer formed thereon is dipped in the coating composition having a desirable resin concentration, typically at room temperature for 5 seconds to 5 minutes, preferably 10 seconds to 1 minute, pulling up the roller, and drying. Where spraying is employed, the coating composition may have a higher resin concentration than used in dipping, for example, 30 to 60% by weight. A coating of a desired thickness can be formed by selecting an appropriate resin concentration, coating technique and conditions without undue experimentation.

The conductive layer may have any desired thickness although a thickness of 0.1 to 100 μm, especially 1 to 50 μm is preferred. Since the conductive layer is formed of a resin composition comprising a specific carbon black, it can be formed to an increased thickness, typically as thick as 10 μm or more without detracting from charging performance and surface strength.

Figure 2:
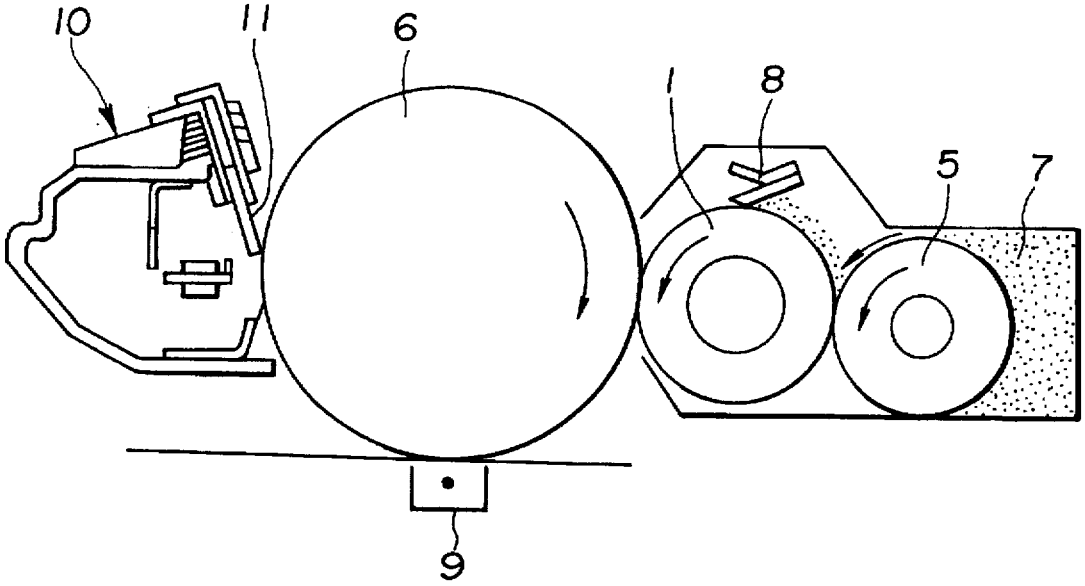
FIG. 2 schematically illustrates an electrophotographic system to which the present invention is applicable.

The developing roller of the invention can be mounted in conventional developing apparatus adapted to use a one-component developer. For example, as shown in FIG. 2, the developing roller 1 is disposed between the toner applicator roller 5 for feeding toner and the photoconductor drum 6 bearing an electrostatic latent image thereon, with the developing roller 1 set in contact with or in close proximity to the photoconductor drum 6. Toner 7 is supplied from the toner applicator roller 5 to the developing roller 1 and regulated into a uniform thin layer by the regulating blade 8. The toner is then supplied from its thin layer on the developing roller to the photoconductor drum 6, thereby adhering the toner to the electrostatic latent image on the drum 6 for visualization. The detail of the arrangement shown in FIG. 2 is omitted since it has already been described.

EXAMPLE

Examples of the present invention are given below by way of illustration and not by way of limitation. All parts are by weight.

Example 1

Preparation of Conductive Paint

A coating composition or conductive paint was prepared by adding a soluble nylon copolymer CM833 (Toray K.K.) to a solvent mixture of methanol and toluene (3:1) so as to give a resin concentration of 10% by weight, and agitating the mixture at 50° C. until the resin was dissolved therein. Carbon black Printex 35 (Degussa Inc.) was added to the solution in an amount of 20 parts per 100 parts of the resin. The mixture was dispersed by means of a sand grinder for 1 hour, completing the conductive paint. It is noted that carbon black Printex 35 (Degussa Inc.) has an oil absorption of 42 ml/100 g and a specific surface area of 65 $m^2/g$.

Formation of Elastic Layer

A developing member was prepared by mixing 100 parts of a polyether polyol obtained by adding propylene oxide and ethylene oxide to glycerin so as to give a molecular weight of 5,000, 125.0 parts of urethane-modified MDI, 2.5 parts of 1,4-butane diol, 0.01 part of dibutyltin dilaurate, and 2.0 parts of Denka Black (Denki Kagaku Kogyo K.K.), casting the mixture into a mold at 110° C. with a metallic shaft set therein, curing the mixture for 2 hours, thereby forming an elastic layer around the shaft. The developing member on the surface was subject to dry abrasion, obtaining a roller-shaped member.

Formation of Conductive Layer

A cylindrical glass container was filled with the conductive paint. The roller-shaped member was dipped in the conductive paint by feeding the member downward at a speed of 1 cm/sec. and pulling up the member at the same speed. A conductive coating was applied to the roller-shaped shaped member. The coating was dried at 80° C. for 2 hours, completing a developing roller having a conductive layer of 20 μm thick on the surface. The developing roller was measured for conductivity between the surface and the shaft to find a fully low resistance. The coating step was efficient. The roller had a hardness of 75 degrees on Ascar C scale and a surface roughness Rz of 5.2 μm on JIS ten point mean roughness scale.

Rating

The developing roller was mounted in a developing unit to construct a developing apparatus as shown in FIG. 2. Using positive chargeable toner, the apparatus was operated to produce a printed image. The printed image was satisfactory and free of fog and density variation.

A charge quantity of toner in the developing unit having the developing roller mounted therein was measured by means of a Faraday gage. The toner had a charge quantity of +25 μC/g, indicating satisfactory charging performance. With a load of 500 grams attached to each end of the developing roller, the developing roller was placed under pressure contact with a photoconductor drum of a laser beam printer in an atmosphere of 50° C. and RH 90% for 5 days. Thereafter, the photoconductor drum was examined to find no defects.

Example 2

A conductive paint was prepared by dissolving a resol type phenolic resin PR50232 (Sumitomo Durez Company, Ltd.) in MEK solvent so as to give a resin concentration of 10% by weight, adding carbon black Printex 35 (Degussa Inc.) to the solution in an amount of 20 parts per 100 parts of the resin, and dispersing the mixture by means of a sand grinder for 1 hour.

As in Example 1, this conductive paint was applied to a roller-shaped member as in Example 1. The coated member was heated at 110° C. for 3 hours for crosslinking the conductive paint coating, completing a developing roller having a conductive layer on the surface. Image evaluation was carried out as in Example 1 using this developing roller. The result was an equivalent image to Example 1. Particularly when an all black image was printed, the printed paper was satisfactory with little difference in density between the leading and trailing edges, indicating that the developer was effectively charged.

Example 3

A developing roller was prepared as in Example 1 except that the amount of urethane-modified MDI blended in the elastic layer was changed to 19.5 parts (index=0.90). The developing roller was measured for conductivity between the surface and the shaft to find a fully low resistance. The coating step was efficient. The roller had a hardness of 65 degrees on Ascar C scale and a surface roughness Rz of 6.3 μm on JIS ten point mean roughness scale.

The developing roller was rated as in Example 1, finding equivalent results.

Example 4

A conductive paint was prepared by blending a silicone resin KR211 (Shin-Etsu Silicone K.K.) in a solvent mixture of MEK, toluene and methanol (7:2:1) so as to give a resin concentration of 20% by weight, agitating the mixture at 50° C. until the resin was dissolved, adding carbon black Printex 35 (Degussa Inc.) to the solution in an amount of 20 parts per 100 parts of the resin, and dispersing the mixture by means of a sand grinder for 1 hour.

A developing roller was prepared as in Example 1 by applying this conductive paint to a roller-shaped member as in Example 1 to form a conductive layer. The developing roller was rated as in Example 1, finding equivalent results including a large toner charge quantity.

Example 5

A conductive paint was prepared by mixing a melamine resin Super Beckamine (Dai-Nihon Ink Chemical Industry K.K.) and an alkyd resin Beckosol (Dai-Nihon Ink Chemical Industry K.K.) in a weight ratio of 5:5, blending the resin mixture in a solvent mixture of MEK, toluene and methanol (7:2:1) so as to give a resin concentration of 20% by weight, agitating the mixture at 50° C. until the resin was dissolved, adding carbon black Printex 35 (Degussa Inc.) to the solution in an amount of 20 parts per 100 parts of the resin, and dispersing the mixture by means of a sand grinder for 1 hour.

A developing roller was prepared as in Example 1 by applying this conductive paint to a roller-shaped member as in Example 1 to form a conductive layer. The developing roller was rated as in Example 1, finding equivalent results including a large toner charge quantity.

Example 6

A conductive paint was prepared by blending a fluorocarbon resin Belflon No. 1000 (Nihon Oil and Fat K.K.) in a solvent mixture of toluene and methanol (7:3) so as to give a resin concentration of 20% by weight, agitating the mixture at 50° C. until the resin was dissolved, adding carbon black Printex 35 (Degussa Inc.) to the solution in an amount of 20 parts per 100 parts of the resin, and dispersing the mixture by means of a sand grinder for 1 hour.

A developing roller was prepared as in Example 1 by applying this conductive paint to a roller-shaped member as in Example 1 to form a conductive layer. The developing roller was rated as in Example 1, finding equivalent results.

Example 7

A developing roller was prepared as in Example 1 except that 0.25 part of quaternary ammonium salt was blended instead of Denka Black in the elastic layer. The developing roller was measured for conductivity between the surface and the shaft to find a fully low resistance. The coating step was efficient. The roller had a hardness of 48 degrees on Ascar C scale and a surface roughness Rz of 6.0 μm on JIS ten point mean roughness scale.

The developing roller was rated as in Example 1, finding equivalent results.

Comparative Example 1

A conductive paint was prepared by adding a soluble nylon copolymer CM833 (Toray K.K.) to a solvent mixture of methanol and toluene (3:1) so as to give a resin concentration of 10% by weight, and agitating the mixture at 50° C. until the resin was dissolved therein. Carbon black Denka Black (Denki Kagaku Kogyo K.K.) was added to the solution in an amount of 20 parts per 100 parts of the resin. The mixture was dispersed by means of a sand grinder for 1 hour, completing the conductive paint. It is noted that Denka Black (Denki Kagaku Kogyo K.K.) has an oil absorption of 125 ml/100 g and a specific surface area of 61 $m^2/g$.

A developing roller was prepared as in Example 1 by applying this conductive paint to a roller-shaped member as in Example 1 to form a conductive layer. The developing roller was examined as in Example 1. The roller had minor variations of resistance on the surface due to insufficient dispersion of carbon, which revealed as image defects.

Comparative Example 2

A conductive paint was prepared by adding a soluble nylon copolymer CM833 (Toray K.K.) to a solvent mixture of methanol and toluene (3:1) so as to give a resin concentration of 10% by weight, and agitating the mixture at 50° C. until the resin was dissolved therein. Carbon black Denka Black (Denki Kagaku Kogyo K.K.) was added to the solution in an amount of 10 parts per 100 parts of the resin. The mixture was dispersed by means of a sand grinder for 1 hour, completing the conductive paint.

A developing roller was prepared as in Example 1 by applying this conductive paint to a roller-shaped member as in Example 1 to form a conductive layer. The developing roller was examined as in Example 1. The roller surface crazed, resulting in a surface layer with poor self reinforcement.

Comparative Example 3

A developing roller was prepared as in Example 1 except that carbon black was omitted from the conductive paint. The developing roller was examined as in Example 1. The roller was satisfactory with respect to reinforcement of a surface layer and contamination to the photoconductor drum. However, when an all black image was printed, the printed image was defective because of a substantial difference in density between the leading and trailing edges.

Comparative Example 4

A developing roller was prepared as in Example 2 except that no conductive layer was formed on the roller-shaped member, that is, the roller-shaped member was used as a developing roller. With a load of 500 grams attached to each end of the developing roller, the developing roller was placed under pressure contact with a photoconductor drum of a laser beam printer in an atmosphere of 50° C. and RH 90% for 5 days. Thereafter, the photoconductor drum was examined, finding that the drum was contaminated. When image printing was continued using the contaminated photoconductor drum, there were produced defective images.

The results of Examples 1–7 and Comparative Examples 1–4 are summarized in the following Table.

TABLE 1

| | | Developing roller | | | Toner | | | |
|---|---|---|---|---|---|---|---|---|
| | Ease of coating | Hardness (JIS-A) | Rz (μm) | Resistance (Ω) | charge (μC/g) | Image | Photoconductor contamination | All black print |
| E1 | Excl. | 52 | 5.2 | $\leqq 10^4$ | +25 | Excl. | Excl. | Good |
| E2 | Good | 55 | 6.5 | $\leqq 10^4$ | +35 | Excl. | Excl. | Excl. |
| E3 | Excl. | 38 | 6.3 | $\leqq 10^4$ | +23 | Excl. | Excl. | Good |
| E4 | Good | 52 | 6.5 | $\leqq 10^4$ | +20 | Good | Good | Good |
| E5 | Good | 52 | 7.4 | $\leqq 10^4$ | +22 | Good | Good | Good |
| E6 | Good | 52 | 7.0 | $\leqq 10^4$ | +30 | Good | Good | Good |
| E7 | Excl. | 48 | 6.0 | $10^7$ | +25 | Excl. | Excl. | Good |
| CE1 | Excl. | 52 | 5.6 | $\leqq 10^4$ | +25 | Poor | Excl. | Good |
| CE2 | Poor | 52 | — | $\leqq 10^4$ | — | — | — | — |
| CE3 | Excl. | 51 | 5.0 | $\leqq 10^4$ | +17 | Good | Poor | Poor |
| CE4 | — | 38 | 8.2 | $\leqq 10^4$ | +15 | Good | Poor | Poor |

In an electrophotographic system wherein a developing roller is adapted to carry a developer on its outer surface to form a thin layer of the developer and come in contact with or close to a photoconductor drum having an electrostatic latent image borne on its surface whereby the developer is supplied to the photoconductor drum to visualize the latent image, according to the invention, the developing roller is constructed as comprising a highly conductive shaft, an elastic layer with conductivity around the shaft, and a conductive layer on the elastic layer containing carbon black having an oil absorption of up to 80 ml/100 g and a specific surface area of up to 150 $m^2/g$. The developing roller has a relatively low hardness, ensures intimate contact with the photoconductor drum, and is improved in electric conduction stability and anti-staining so that acceptable images can be consistently produced over a long term. Using the inventive developing roller, a developing apparatus can consistently produce acceptable images over a long term.

Although some preferred embodiments have been described, many modifications and variations may be made thereto in the light of the above teachings. It is therefore to be understood that within the scope of the appended claims, the invention may be practiced otherwise than as specifically described.

We claim:

1. A developing roller to carry a developer on its surface to form a thin layer of the developer and come in contact with or close to a latent image holder having an electrostatic latent image borne on its surface such that the developer is supplied to the latent image holder to visualize the latent image, said developing roller comprising a highly conductive shaft, an elastic layer with conductivity formed around the shaft, and a conductive layer on said elastic layer containing carbon black having an oil absorption of up to 80 ml/100 g and a specific surface area of up to 150 $m^2/g$.

2. The developing roller of claim 1 wherein said conductive layer contains a soluble nylon copolymer.

3. The developing roller of claim 1 wherein said conductive layer contains a phenolic resin.

4. The developing roller of claim 1 wherein said conductive layer contains at least one resin selected from the group consisting of a silicone resin, melamine resin, fluorocarbon resin, alkyd resin, and modified resin thereof.

5. The developing roller of claim 1 which is used to develop the electrostatic latent image with a positively charged one-component developer.

6. An apparatus for developing an electrostatic latent image comprising, a latent image holder for bearing an electrostatic latent image on its surface and a developing roller for carrying a developer on its surface wherein said developing roller is brought in contact with or close to the surface of said latent image holder such that the developer is adhered to the latent image on the surface of said latent image holder to visualize the latent image, said developing roller comprising a highly conductive shaft, an elastic layer with conductivity formed around the shaft, and a conductive layer on said elastic layer containing carbon black having an oil absorption of up to 80 ml/100 g and a specific surface area of up to 150 $m^2/g$.

7. The apparatus of claim 6 wherein the developer is a positively charged one-component developer.

8. The apparatus of claim 6 wherein said conductive layer of the developing roller contains a soluble nylon copolymer.

9. The apparatus of claim 6 wherein said conductive layer of the developing roller contains a phenolic resin.

10. The apparatus of claim 6 wherein said conductive layer of the developing roller contains at least one resin selected from the group consisting of a silicone resin, melamine resin, fluorocarbon resin, alkyd resin, and modified resin thereof.

* * * * *